United States Patent [19]

Bender

[11] Patent Number: 4,683,680

[45] Date of Patent: Aug. 4, 1987

[54] METHOD AND APPARATUS FOR PRODUCING BORES HAVING A HIGH SURFACE QUALITY

[75] Inventor: Albert Bender, Ostfildern, Fed. Rep. of Germany

[73] Assignee: Maschinenfabrik Gehring Gesellschaft mit beschränkter Haftung & Co. Kommanditgesellschaft, Fed. Rep. of Germany

[21] Appl. No.: 802,857

[22] Filed: Nov. 27, 1985

[30] Foreign Application Priority Data

Nov. 27, 1984 [DE] Fed. Rep. of Germany ..... 3443106

[51] Int. Cl.[4] ..... B24B 7/00; B24B 9/00

[52] U.S. Cl. ..... 51/34 J; 51/290; 51/165.93

[58] Field of Search ..... 51/34 H, 34 J, 34 R, 51/34 C, 34 D, 165.93, 165.92, 165.9, 290, 338, 349

[56] References Cited

U.S. PATENT DOCUMENTS 2,403,546 7/1946 Olsen ..... 51/290

3,466,809 9/1969 Estabrook ..... 51/34 R

*Primary Examiner*—Frederick R. Schmidt
*Assistant Examiner*—Maurina Rachuba
*Attorney, Agent, or Firm*—Becker & Becker, Inc.

[57] ABSTRACT

A method and apparatus for producing, in workpieces, bores having a high surface quality, and especially for producing cylinder bores in engine cylinder blocks. At least one fine surface machining is carried out with a rotating honing tool that executes a contrarotating stroke movement in the direction of the axis of a bore. The honing tool has honing stones that can be pressed radially against the wall of the bore via a feed system. The method and apparatus preclude damaging effects upon the surface quality of a bore as a result of the movement reversal of the honing tool. This is accomplished by reducing the force, with which the honing stones are pressed against the bore wall, during the reversal of the direction of the stroke movement of the honing tool. In particular, the pressure in the cylinder space of the piston/cylinder arrangement of the apparatus is reduced during reversals of the direction of the stroke movement of the honing tool.

15 Claims, 2 Drawing Figures

METHOD AND APPARATUS FOR PRODUCING BORES HAVING A HIGH SURFACE QUALITY

BACKGROUND OF THE INVENTION

1. Field of the Invention

The present invention relates to a method of producing, in workpieces, bores having a high surface quality or finish; the method is particularly applicable to producing cylinder bores in engine cylinder blocks. The present invention also relates to an apparatus for carrying out such a method.

2. Description of the Prior Art

With heretofore known methods, a deterioration of the surface quality of the bore frequently occurs in that region where a reversal of direction of the stroke movement of a honing tool occurs. With regard to the preferred application of the present invention, namely for the production of cylinder bores, for example in engine cylinder blocks, reversals of the stroke movement are effected at locations of the honing tool not only in the region of the end that faces the cylinder head, but also in the region of that end of the cylinder block that faces the crankshaft. In these regions of the stroke reversal, it is not possible pursuant to the state of the art to maintain a honing angle value that is favorable with regard to the oil adhesion and sealing achieved with the piston rings. This honing angle refers to the angle of intersecting, linear machining scoring resulting from the stroke and rotational movements of the tool. In the deceleration and acceleration regions, the angle is less than the desired value, while the angle is 0° at the reversal points. Therefore, the appearance the surface of the bore in these regions is not uniform. Rather, in conformity with the number and arrangement of the engaging honing stones, more or less small sections having short curved machining scorings are present; these sections represent an undesired deterioration of the surface quality.

Attempts have been made to eliminate the aforementioned drawbacks by disposing pairs of engine cylinder blocks in opposite directions with their cylinder head ends abutting one another; the aligned cylinder bores of a given pair of engine blocks are then machined as a single bore. However, in so doing, the damaging affect of the surface quality can be avoided for only that region of the cylinder bore that faces the cylinder head.

In addition, this heretofore known solution requires that the honing tool be introduced into the cylinder bore from the side of the crankshaft. However, with many engine blocks, this is not possible due to the crankshaft bearing members. Thus, in most cases, the heretofore known solution cannot be utilized.

An object of the present invention is to provide a method of the aforementioned general type, as well as an apparatus for carrying out such a method, whereby the aforementioned drawback, namely the affect that the reversal of movement of a honing tool has upon the surface quality of a bore, is avoided.

BRIEF DESCRIPTION OF THE DRAWINGS

This object, and other objects and advantages of the present invention, will appear more clearly from the following specification in conjunction with the accompanying drawings, in which.

SUMMARY OF THE INVENTION

Figure 1:
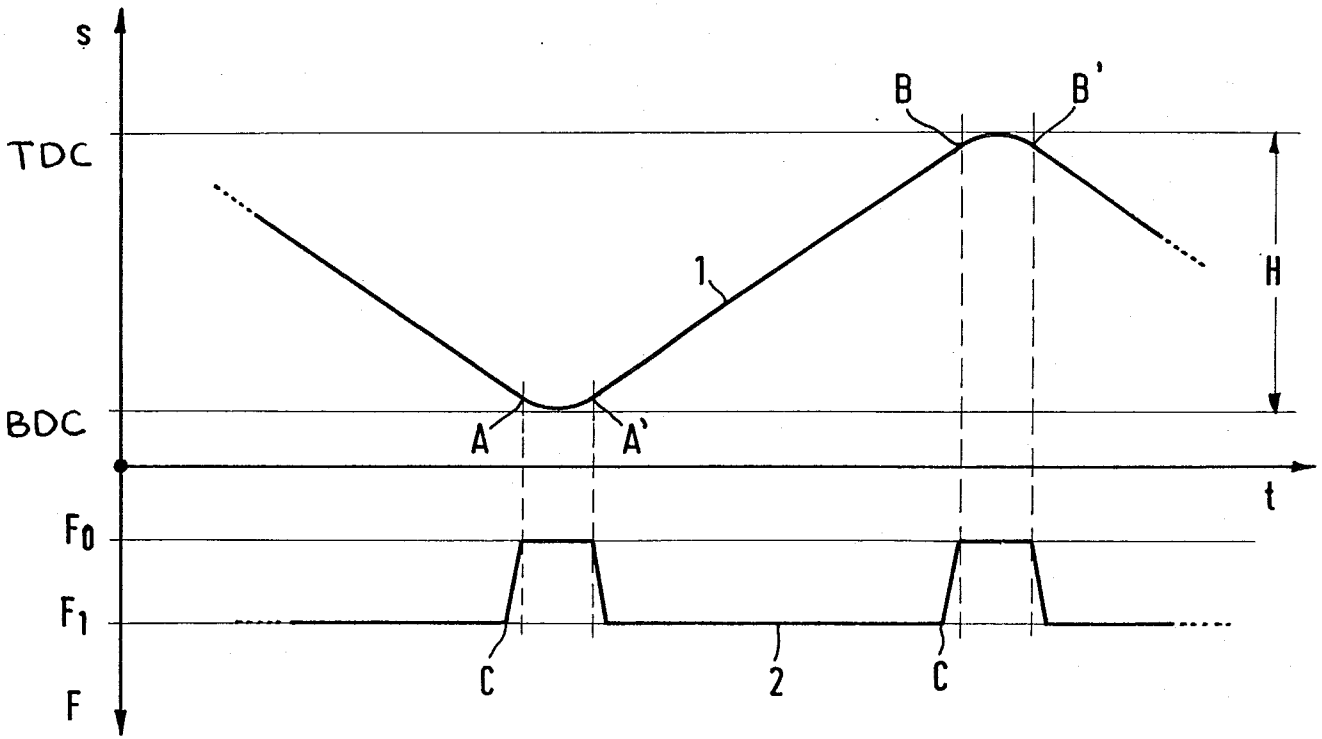
FIG. 1 shows a displacement (s)-time (t) graph of the stroke movement of one inventive embodiment of a honing tool, and also shows the associated curve of the cutting force (F) of the honing stones during a portion of the machining of a bore.

The method of the present invention includes the steps of carrying out at least one fine surface machining with a rotating honing tool that executes a contrarotating stroke movement in the direction of the axis of a given bore, and that has honing stones which can be pressed radially against the wall of the bore via a feed system; and reducing the force, with which the honing stones are pressed against the bore wall, during reversal of the direction of the stroke movement of the honing tool.

The apparatus for carrying out this method comprises a rotating honing tool that executes a contrarotating stroke movement in the direction of the axis of a given bore, and that has honing stones which can be pressed radially against the wall of the bore; and a feed system for effecting the radial pressing of the honing stones, with the feed system including a preferably hydraulic feed mechanism having a piston/cylinder arrangement for effecting the stroke movement of the honing tool; the piston/ cylinder arrangement has a cylinder space in which the pressure is reduced during reversals of the direction of the stroke movement of the honing tool.

By reducing the honing pressure, and hence the cutting force of the honing stones, in the regions of the stroke reversal, i.e. in the deceleration and acceleration phases of the stroke movement, a cutting action by the honing stones is prevented during this time, or at least is reduced to such an extent that damage to the surface of the bore is precluded.

Further specific features of the present invention will be described subsequently.

DESCRIPTION OF PREFERRED EMBODIMENTS

Referring now to the drawings in detail, the honing tool 5 (FIG. 2) carries out a contrarotating stroke movement between the direction-reversal points BDC and TDC (FIG. 1), which delimit the magnitude of the stroke travel. The honing stones 9 (FIG. 2) of the honing tool 5 press against the wall 10, of the cylinder bore of a cylinder or the like that is to be honed, with a given force (pressing force). The speed of the stroke movement is essentially constant between the stroke reversals, as indicated by the longer, straight portions of the line 1 in the displacement-time graph of FIG. 1. At point A, the reversal of the stroke movement is initiated; in other words, the moved unit must be decelerated until it stops, and must then immediately be accelerated again in the opposite direction. The curved progress of the line 1 in this region shows that the speed is rapidly reduced, achieves the value zero at the reversal point BDC (low point of the curve), and then increases rapidly in order at the point A′ to again achieve the operating speed. The same applies for the stroke reversal at the upper reversal point TDC, as indicated by the points B and B′.

The line 2 of the lower portion of the graph illustrated in FIG. 1 is coordinated with the stroke movement and plots the inventive progress of the pressing force of the honing stones against the bore wall versus time. As can be clearly seen, in the curved region of the line 1 between the points A and A' and B and B', the honing force is suddenly reduced from $F_1$ to $F_0$, and is preferably reduced to the point where $F_0=0$. This means that in the deceleration and acceleration phases of the honing tool, i.e. during stroke reversal, the honing stones can no longer cut and do not produce any scoring.

The inventive interruption of the cutting force of the honing stones is achieved during the stroke reversal by briefly backing off the feed system or feed mechanism; this backing off is triggered by the stroke control mechanism.

For this purpose, pursuant to a further feature of the present invention, the entire feed system is preloaded counter to the feed direction. In this way, interruption of the cutting force can be achieved particularly rapidly, as can be seen from the nearly rectangular progress of the force line 2 (FIG. 1) as it is plotted versus time.

Figure 2:
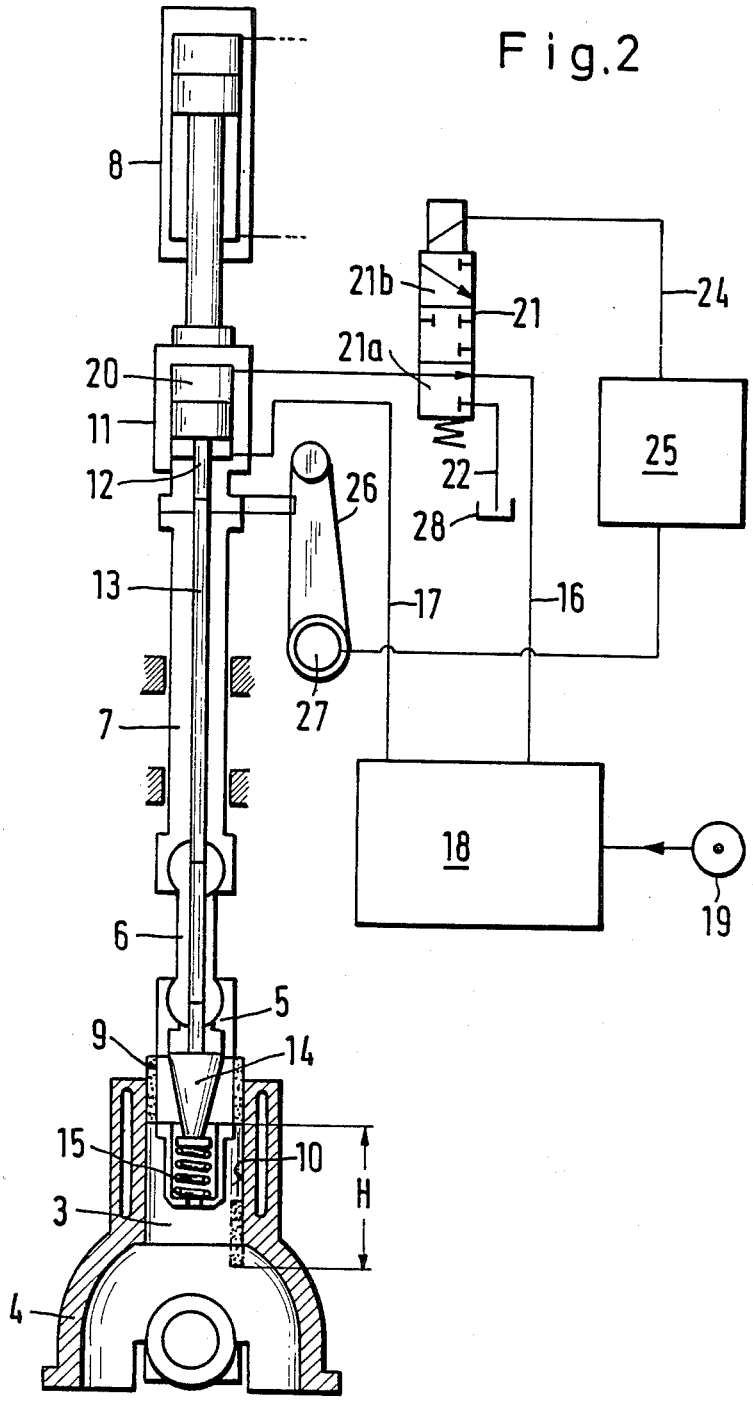
FIG. 2 shows one exemplary embodiment of an apparatus for carrying out the method of the present invention.

FIG. 2 schematically illustrates one inventive embodiment of a honing tool designed for the application of the inventive method. The cylinder bore 3 of an engine cylinder block 4 is machined by the honing tool 5, which is rotatably driven in a known manner, and executes a stroke movement or travel H in the direction of the central axis of the bore.

For this purpose, the honing tool 5 is connected in the manner of a universal joint with a honing spindle 7 via a connecting rod 6. The honing spindle 7 is part of a non-illustrated honing machine, and can be moved up and down by a hydraulic lifting drive mechanism, namely a piston/cylinder arrangement 8. In addition, the honing spindle 7 is rotatably driven about its longitudinal axis in a known manner by a non-illustrated rotary drive mechanism. The honing tool 5 is provided with the honing stones 9, which can be fed radially outwardly by a hydraulically operated feed device, and which can be pressed against the wall 10 of the cylinder bore 3. The hydraulic operating mechanism of the feed device comprises a piston/cylinder arrangement 11, the piston rod 12 of which presses against the top of the feed cone 14 of the honing tool 5 via a multi-part feed rod 13 that passes through the honing spindle 7 and the connecting rod 6, and leads to the honing tool 5. A strong spring 15 presses against the bottom of the feed cone 14 in the opposite direction, thus effecting a mechanical preloading of the feed system. The hydraulic cylinder 11 is supplied via lines 16, 17 from a hydraulic control unit 18, that is connected to a source 19 of pressure medium.

A three-way valve 21 is interposed in the line 16, which leads to the upper cylinder space 20 of the piston/cylinder arrangement 11. Via this three-way valve 21, the upper cylinder space 20 can be connected directly with a return line 22 that leads to the pressure medium reservoir 28. Furthermore, the threeway valve 21 is connected via a control line 24 with an electrical stroke control device 25 that controls the stroke reversal via a motion or displacement transmitter 27 that is mechanically coupled with the stroke movement of the honing spindle 7, for example via the chain drive 26.

The apparatus described in FIG. 2 operates as follows:

The displacement transmitter 27, which is connected via the chain drive 26 with the honing spindle 7 that moves up and down, operates as an actual value transmitter and continuously transmits the present position of the honing tool 5 to the stroke control device 25. In the control device 25, these values are compared in a known manner with predetermined desired values for the stroke reversal points (BDC, TDC); when the values are indentical, the stroke reversal is effected.

Furthermore, for each stroke reversal, the stroke control device 25 inventively transmits, via the control line 24, a signal to the three-way valve 21. The valve 21 changes from the position 21*a*, in which the upper cylinder space 20 of the piston/cylinder arrangement 11, for purposes of the hydraulic operation of the feed device, is supplied via the line 16 from the hydraulic control unit 18, into the position 21*b*. The three-way valve 21 remains in this position as long as the signal is emitted via the control line 24.

In the switch position 21*b*, the line 16 to the hydraulic control unit 18 is interrupted. The cylinder space 20 is now connected with the return line 22, and pressure medium flows out of the cylinder space 20 back into the reservoir 28. The pressure in the cylinder space 20, which is controlling for the force with which the honing stones 9 press against the bore wall 10 during honing, drops suddenly, and the preload spring 15 effects a rapid resetting of the feed system; the honing stones 9 are no longer pressed against the bore wall 10, and immediately cease to cut.

After rescinding of the signal in the line 24, the slide valve 21 switches back to the position 21*a*, and filling of the cylinder space 20 is immediately effected via the line 16 until the preset pressure is achieved and the honing stones 9 again press with the appropriate force against the bore wall 10 and begin to cut.

The initiation, duration, and sequence of the control signal in the line 24 inventively precede the stroke reversal via known electrical means, and are controlled in such a way that while taking into consideration the existing mechanical and hydraulic deceleration times, the actual interruption of the cutting force of the honing stones 9 coincides with the beginning, duration, and sequence of the stroke reversal, as can be readily seen in the graph of FIG. 1. The control is advantageously such that the beginning of the reduction of the cutting force (point C of the line 2 in FIG. 1) is timely effected in such a way that at the beginning of the stroke reversal (point A or B of the line 1 in FIG. 1), the preset reduced cutting force $F_0$ is already fully achieved, and is maintained until the conclusion of the stroke reversal (point A' or B').

The inventive method of at least reducing the cutting force of the honing stones during the stroke reversal, and preferably of entirely interrupting the cutting force, can be utilized during the entire duration of honing a workpiece.

Where multi-stage machining is involved, the inventive method is advantageously utilized during only the final machining. It may also be quite sufficient and advantageous to utilize the inventive method during at least one, and preferably several, stroke reversals prior to the achievement of the final dimension.

Naturally, it is to be understood that the inventive method is not limited to the described hydraulic operation of a feed device, but can also be utilized in a suitable form for all known operating mechanisms for feeding honing stones.

Thus, for example, it is also possible to achieve the inventive reduction of the cutting force during the stroke reversal with an electro-mechanical operating mechanism of the feed device achieved via a stepping motor or servomotor in conjunction with a spherical threaded drive, via a brief reversal of rotation triggered by the stroke control mechanism.

The present invention is, of course, in no way restricted to the specific disclosure of the specification and drawings, but also encompasses any modifications within the scope of the appended claims.

What I claim is:

1. A method of producing, in workpieces, round bores having a high surface quality; said method comprising the steps of:

carrying out at least fine surface machining with a rotating honing tool that executes a reciprocated stroke movement in the direction of the axis of a given bore, and that has honing stones which can be pressed radially aganist the wall of said bore via a feed system; and reducing the force, with which said honing stones are pressed against said bore wall, during reversals of the direction of said stroke movement of said honing tool to preclude damaging upon effects said roundness of the bores in a critical region of reversal of stroke movement.

2. A method according to claim 1, in which said reducing step comprises reducing the force, with which said honing stones are pressed against said bore wall, to zero during reversals of the direction of said stroke movement of said honing tool.

3. A method according to claim 1, which includes the step of undertaking a reduction of the cutting force of said honing stones during stroke reversal by triggering a resetting of said feed system via a stroke control mechanism.

4. A method according to claim 3, which includes the step of prestressing said feed system counter to the feed direction thereof.

5. A method according to claim 3, which includes the step of controlling the beginning, duration, and sequence of the resetting of said feed system in such a way that the actual reduction of the cutting force of said honing stones coincides with the beginning, duration, and sequence of the stroke reversal.

6. A method according to claim 5, in which said controlling step takes into account existing mechanical and hydraulic deceleration times, and is such that the beginning of the reduction of the cutting force is so timely effected that at the start of stroke reversal a preset, reduced cutting force is achieved and is maintained until conclusion of that stroke reversal.

7. A method according to claim 1, which is used, for reducing the cutting force of said honing stones during stroke reversal, during the entire time a given workpiece is being machined.

8. A method according to claim 1, which is used, for reducing the cutting force of said honing stones during stroke reversal, during the time a given workpiece is finish machined.

9. A method according to claim 1, which is used, for interrupting the cutting force of said honing stones during stroke reversal, during at least one stroke reversal prior to achieving a finished dimension.

10. An apparatus for producing, in workpieces, round bores having a high surface quality; said apparatus comprising:

a rotating honing tool that executes a reciprocated stroke movement in the direction of the axis of a given bore, and that has honing stones which can be pressed radially against the wall of said bore; and a feed system for effecting said radial pressing of said honing stores, said system including a feed mechanism having a piston/cylinder arrangement for effecting feed of said honing tool; said piston/cylinder arrangement honing means including cylinder space wherein pressure is reduced during reversals of the direction of said stroke movement of said honing tool to preclude damaging effects upon the roundness of the bores in a critical region of reversal of stroke movement.

11. An apparatus according to claim 10, which includes a pressure medium line that communicates with a source of pressure medium and with said cylinder space; which includes a slide valve disposed in said pressure medium line; and which includes a return line that communicates with said cylinder space via said slide valve.

12. An apparatus according to claim 11, in which said slide valve is controlled as a function of said stroke movement of said honing tool.

13. An apparatus according to claim 11, in which said feed system includes a feed cone that is operatively associated with said honing tool, and also includes a prestressing mechanism that acts upon that side of said feed cone remote from said cylinder space, and acts counter to the feed direction of said feed system.

14. An apparatus according to claim 13, in which said prestressing mechanism is a compression spring for resetting said feed system; and in which said cylinder space communicates with a pressure medium reservoire via said return line.

15. An apparatus according to claim 11, which includes a stroke control device that communicates with said slide valve for transmitting a control signal thereto.

* * * * *